US008044868B2

(12) United States Patent
Ko et al.

(10) Patent No.: US 8,044,868 B2
(45) Date of Patent: Oct. 25, 2011

(54) PCB TYPE DUAL BAND PATCH ANTENNA AND WIRELESS COMMUNICATION MODULE INCORPORATING THE SAME PCB TYPE DUAL BAND PATCH ANTENNNA

(75) Inventors: Young-Joon Ko, Daejeon (KR); Jae-Young Kim, Daejeon (KR); Kwang-Roh Park, Daejeon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 421 days.

(21) Appl. No.: 12/443,083

(22) PCT Filed: Jul. 4, 2007

(86) PCT No.: PCT/KR2007/003237

§ 371 (c)(1),
(2), (4) Date: Mar. 26, 2009

(87) PCT Pub. No.: WO2008/038892

PCT Pub. Date: Apr. 3, 2008

(65) Prior Publication Data

US 2010/0090907 A1 Apr. 15, 2010

(30) Foreign Application Priority Data

Sep. 29, 2006 (KR) ..... 10-2006-0096564

(51) Int. Cl.
*H01Q 1/24* (2006.01)

(52) U.S. Cl. ..... 343/702; 343/700 MS; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 6,683,576 | B2 * | 1/2004 | Achim | 343/702 |
| 6,943,749 | B2 * | 9/2005 | Paun | 343/795 |
| 7,187,329 | B2 * | 3/2007 | Okado | 343/700 MS |
| 7,411,556 | B2 * | 8/2008 | Sanz et al. | 343/702 |
| 2006/0025897 | A1 | 2/2006 | Shostak et al. | |

FOREIGN PATENT DOCUMENTS

| | | | |
|---|---|---|---|
| JP | 2004-165770 | A | 6/2004 |
| KR | 1020040054042 | A | 6/2004 |
| WO | 2005/018045 | A1 | 2/2005 |

OTHER PUBLICATIONS

International Search Report; mailed Oct. 8, 2007; PCT/KR2007/003237.

* cited by examiner

*Primary Examiner* — Hoang V Nguyen
(74) *Attorney, Agent, or Firm* — Ladas & Parry LLP

(57) ABSTRACT

The invention provides a PCB type dual band patch antenna and a wireless communication module incorporating the antenna. The antenna includes a substrate. A ground pattern is formed on the substrate. A radiating patch is formed on the substrate to be spaced apart from the ground pattern at a predetermined distance. The radiating patch includes an input arm and a main radiator which are divided by a slot with 'L' and inverse 'L' shapes combined. The main radiator has an open terminal opposing the input arm across the slot. Also, a feeding part is connected to the input arm of the radiating patch to apply an electrical signal to the radiating patch. Further, wireless devices are integrally mounted on the PCB substrate used for the antenna, thereby achieving a high efficiency and wide-bandwidth dual band patch antenna and a minimal-sized and low-cost wireless communication module.

11 Claims, 7 Drawing Sheets

[Fig. 1]
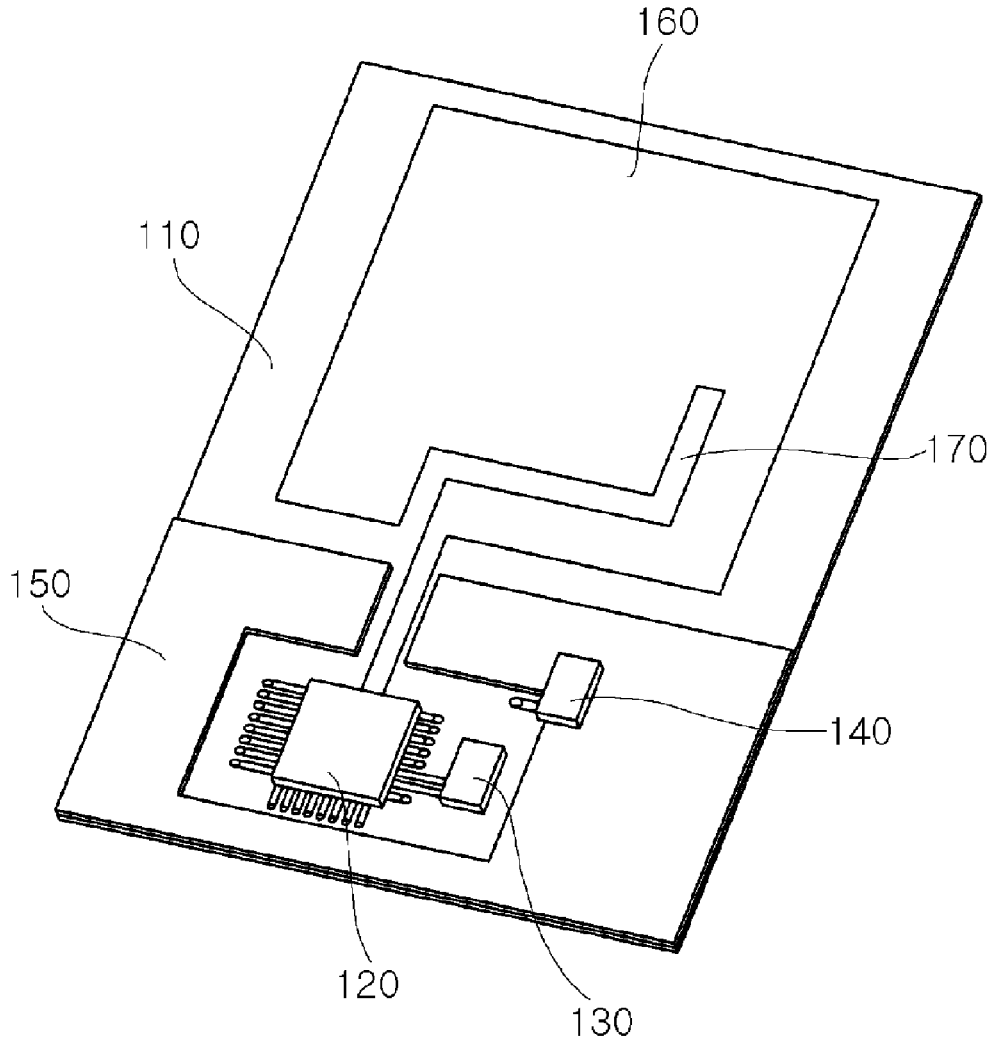

[Fig. 2]
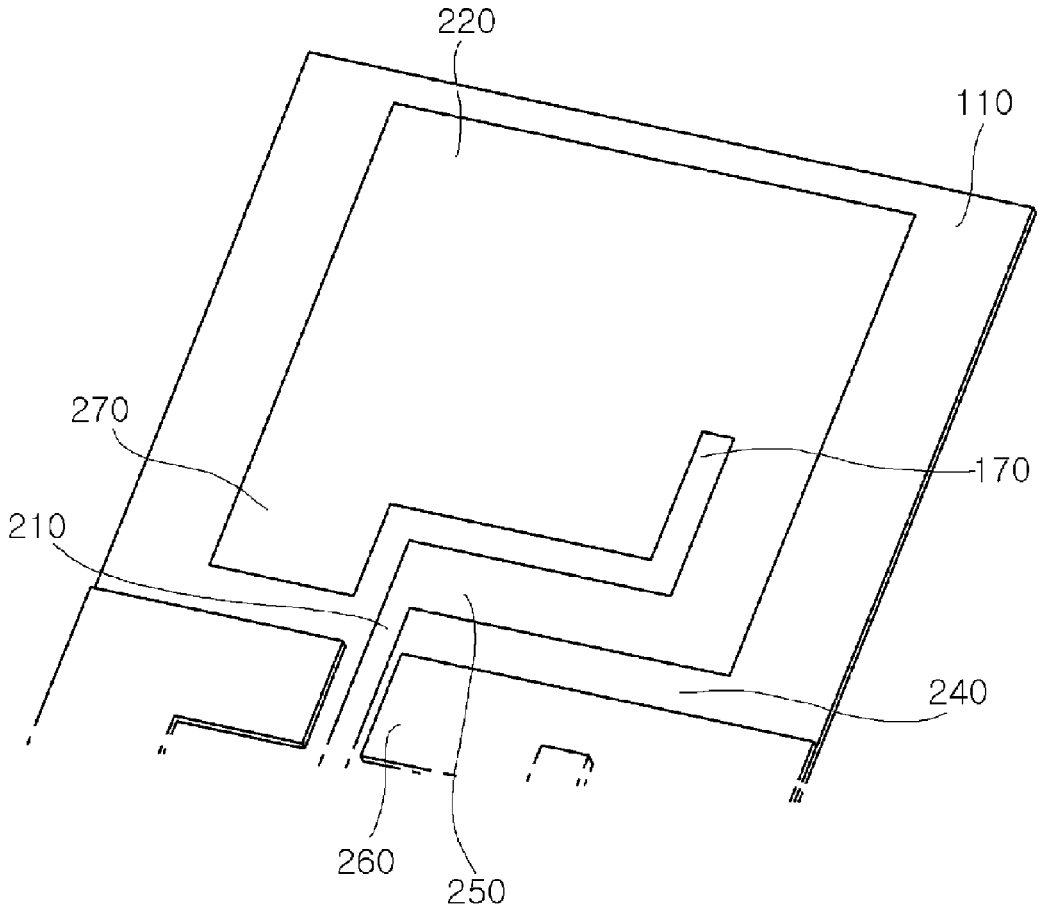

[Fig. 3]
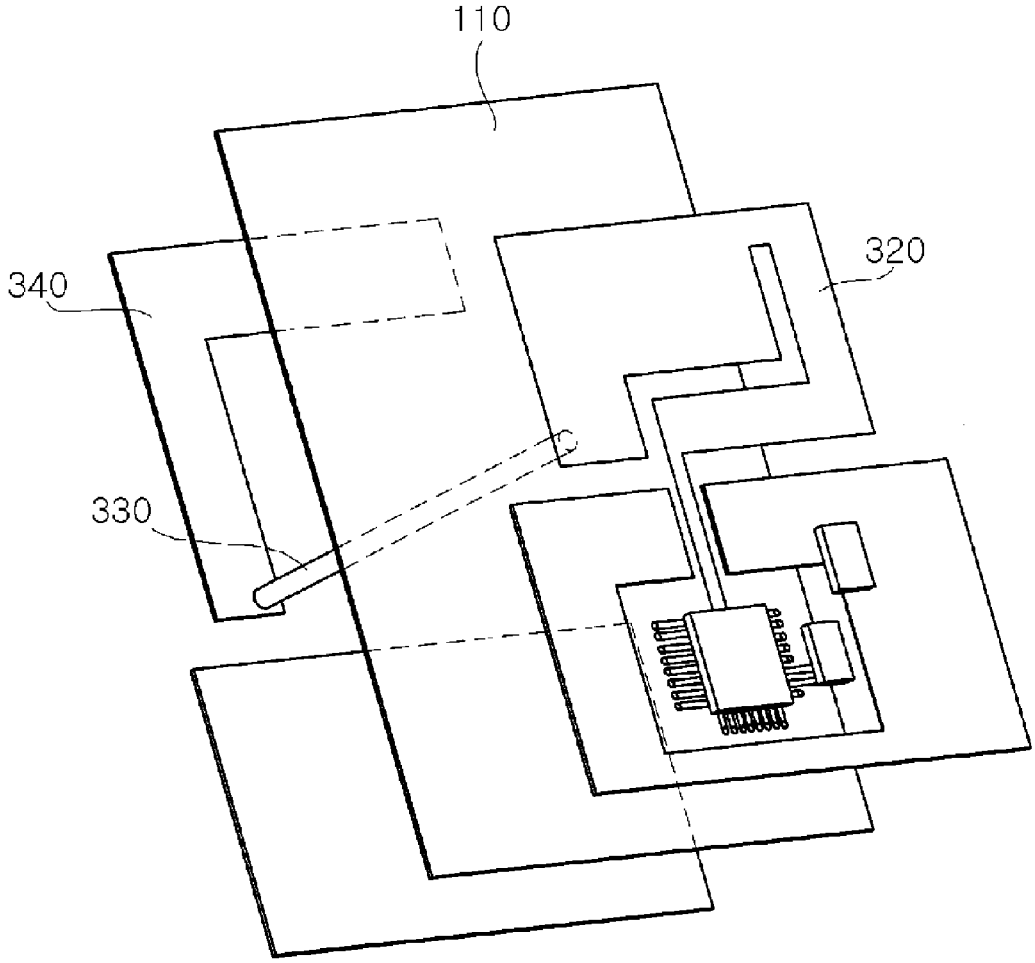

[Fig. 4]
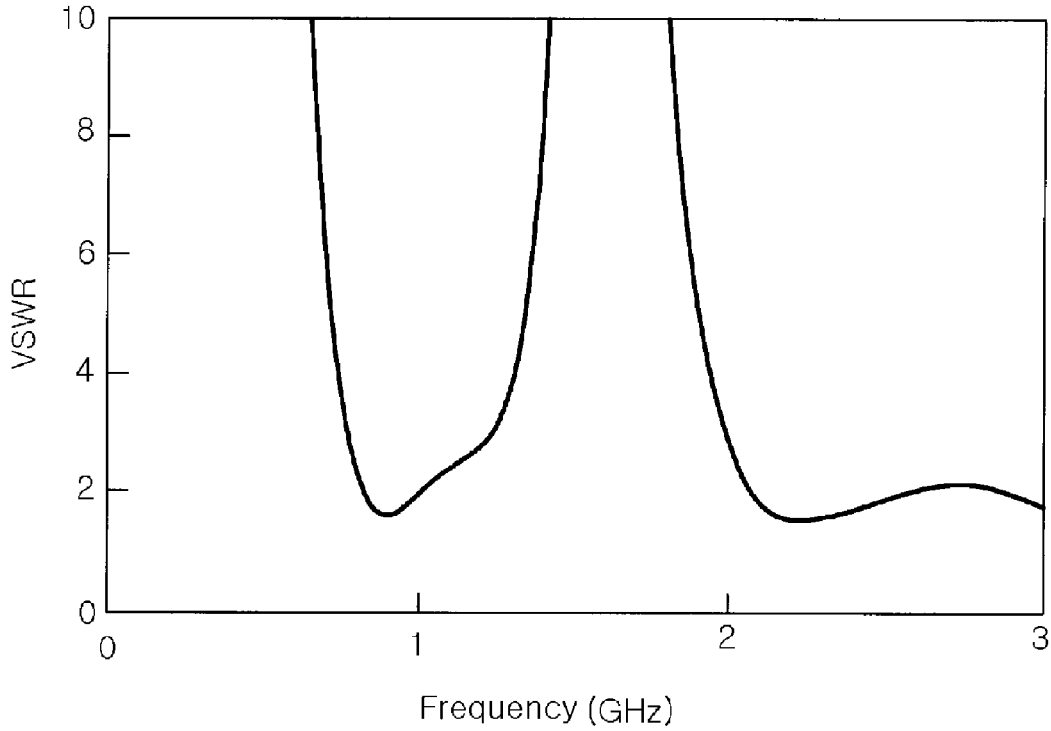

[Fig. 5]
(a)
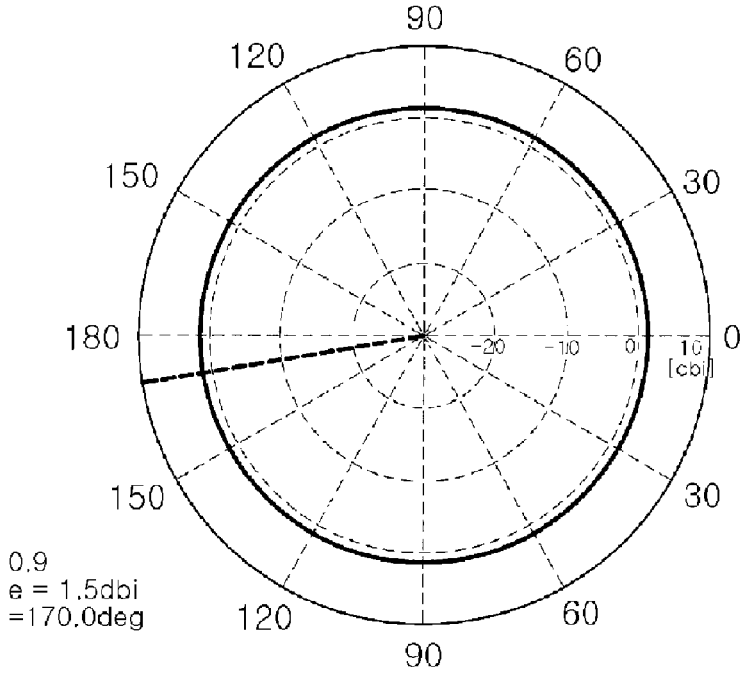
(b)
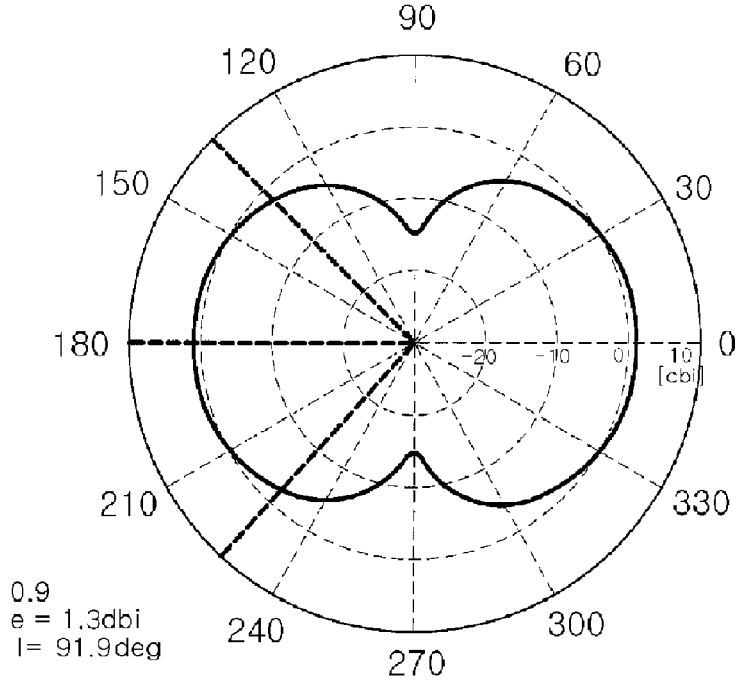

[Fig. 6]
(a)
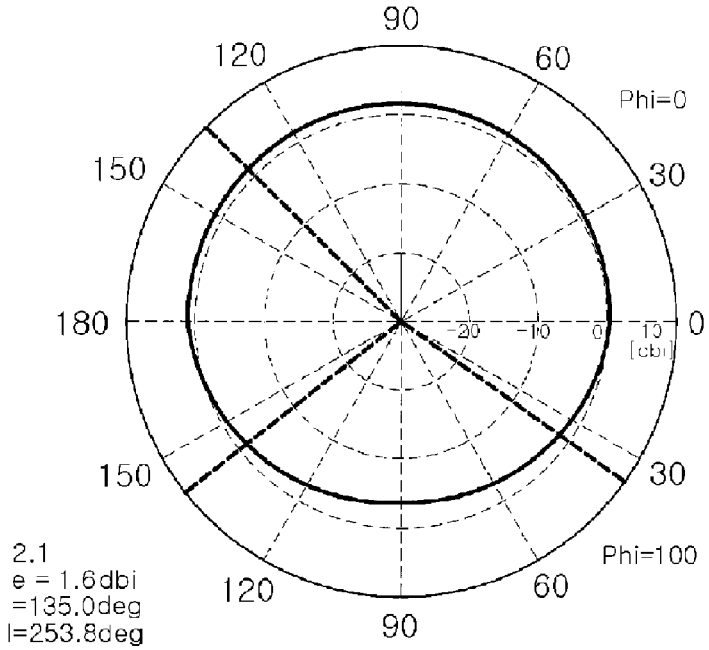
(b)
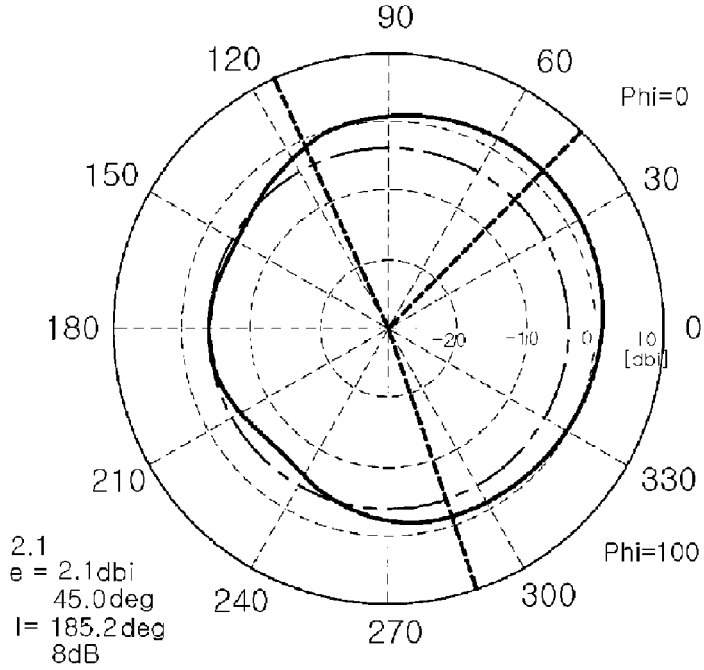

[Fig. 7]
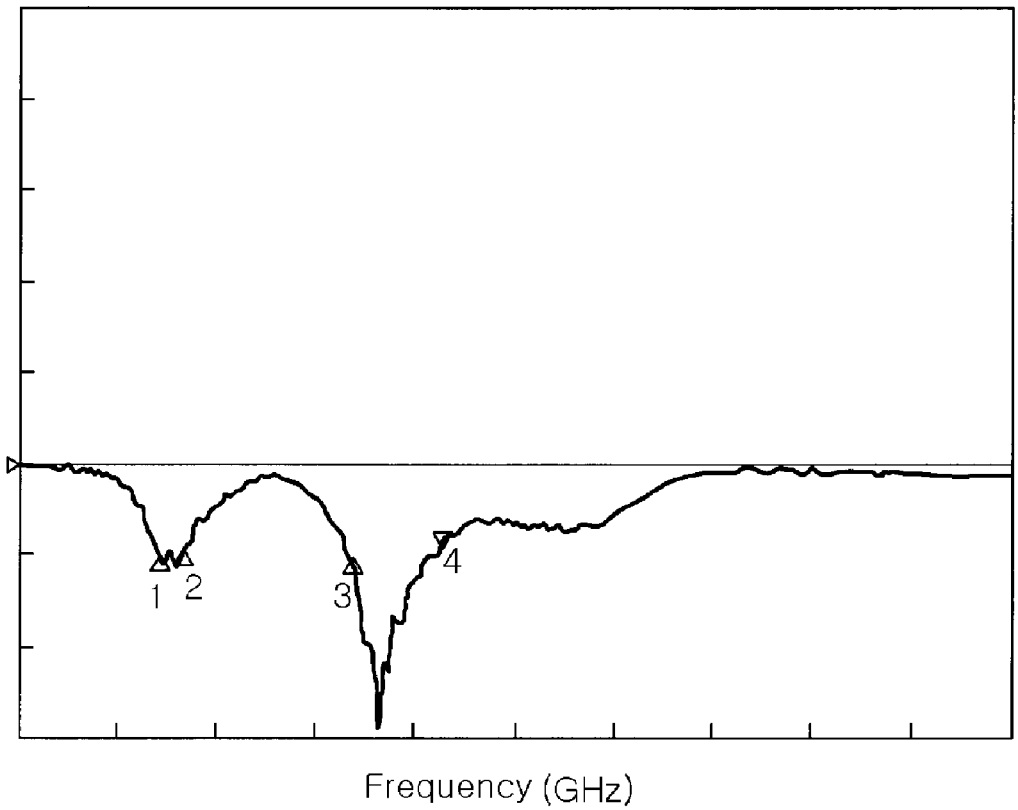

PCB TYPE DUAL BAND PATCH ANTENNA AND WIRELESS COMMUNICATION MODULE INCORPORATING THE SAME PCB TYPE DUAL BAND PATCH ANTENNNA

TECHNICAL FIELD

The present invention relates to a printed circuit board type dual band patch antenna and a wireless communication module incorporating the same. More particularly, the present invention relates to a high-performing, low-cost dual band patch antenna applicable to both frequency bands of IEEE 802.15.4/4a and a wireless communication module incorporating the same.

BACKGROUND ART

With development of a wireless mobile communication technology, electronic products are embedded with a wireless mobile communication system and a wireless sensor system. An antenna is a chief communication component for determining capability of the wireless communication products. Meanwhile, an IEEE 802.15.4/4a wireless communication system has found a growing application in detection and control systems such as home automations and office automatic sensors. For now, the IEEE 802.15.4 wireless communication system has been commercialized at a bandwidth of 2400 MHz. However, the IEEE 802.15.4 system for 2400 MHz bandwidth may experience interference with the existing wireless LAN frequency. Therefore, the IEEE 802.15.4 system for 900 MHz bandwidth is being developed at home. This crucially necessitates a dual band antenna for covering both bandwidths of 900/2400 MHz for the IEEE 802.15.4 system and the IEEE 802.15.4a system which is to be standardized later.

Conventionally, the IEEE 802.15.4 wireless communication system mainly employs a monopol or helical antenna, and a ceramic chip antenna in the applications thereof to reduce size. However, the external antenna is easily altered in its characteristics by external environment, while the internal ceramic chip antenna degrades capability of the wireless communication system due to decline in gain thereof. Moreover, a separate antenna is required for each of the IEEE 802.15.4/4a wireless communication modules, thereby creating additional costs.

DISCLOSURE OF INVENTION

Technical Problem

The present invention has been made to solve the foregoing problems of the prior art and it is therefore an object according to certain embodiments of the present invention to provide a PCB type dual band patch antenna individually applicable to IEEE 802.15.4/4a communication systems at 900 MHz and 2400 MHz bandwidths, and a high-efficient and low-cost wireless communication module.

Technical Solution

According to an aspect of the invention for realizing the object, there is provided a printed circuit board type dual band patch antenna including: a substrate; a ground pattern formed on the substrate; a radiating patch formed on the substrate to be spaced apart from the ground pattern at a predetermined distance, the radiating patch including an input arm and a main radiator which are divided by a slot with 'L' and inverse 'L' shapes combined, the main radiator having an open terminal opposing the input arm across the slot; and a feeding part connected to the input arm of the radiating patch to apply an electrical signal to the radiating patch.

The printed circuit board type dual band patch antenna further includes a lower pattern formed underneath the substrate not to be superimposed with the main radiator, the lower pattern connected to the open terminal of the main radiator through a via hole formed in the substrate.

The printed circuit board type dual band patch antenna further includes a lower pattern formed underneath the substrate not to be superimposed with the main radiator, the lower pattern connected to the open terminal of the main radiator through a via hole formed in the substrate.

The input arm of the radiating patch and the open terminal of the main radiator each are spaced apart from the ground pattern at an equal distance.

Also, the feeding part applies the electrical signal by a coplanar waveguide feeding.

The lower pattern has a shape selected from a group consisting of 'L', inverse 'L' and straight line According to another aspect of the invention for realizing the object, there is provided a wireless communication module including: a substrate; a ground pattern formed on the substrate; a printed circuit board type dual band patch formed on the substrate to be spaced apart from the ground pattern at a predetermined distance; and a wireless communication device formed on the substrate to be encompassed by the ground pattern.

In the wireless communication module, the printed circuit board type dual band patch antenna includes a radiating patch formed on the substrate to be spaced apart from the ground pattern at a predetermined distance, the radiating patch including an input arm and a main radiator which are divided by a slot with 'L' and inverse 'L' shapes combined, the main radiator having an open terminal opposing the input arm across the slot; and a feeding part connected to the input arm of the radiating patch to apply an electrical signal to the radiating patch.

Moreover, in the wireless communication module, the printed circuit board type dual band patch antenna further includes a lower pattern formed underneath the substrate not to be superimposed with the main radiator, the lower pattern connected to the open terminal of the main radiator through a via hole formed in the substrate.

In the wireless communication module, the feeding part applies the electrical signal by a coplanar waveguide feeding.

In the wireless communication module, the lower pattern has a shape selected from a group consisting of 'L', inverse 'L', and straight line.

Advantageous Effects the present invention provides a PCB type dual band patch antenna individually applicable to IEEE 802.15.4/4a communication systems at 900 MHz and 2400 MHz bandwidths, and a high-efficient and low-cost wireless communication module.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a top view illustrating a wireless communication module incorporating a PCB type dual band patch antenna according to an embodiment of the invention;

FIG. 2 is a partially magnified view illustrating a dual band patch antenna of FIG. 1;

FIG. 3 is an exploded perspective view illustrating a wireless telecommunication module incorporating a PCB type dual band patch antenna according to another embodiment of the invention;

FIG. 4 is a graph illustrating return loss of the PCB type antenna shown in FIG. 2;

FIGS. 5(*a*) and (*b*) illustrate radiation patterns of the PCB type antenna of FIG. 2 plotted in an H-plane and an E-plane at a 900 MHz bandwidth, respectively;

FIGS. 6(*a*) and (*b*) illustrate radiation patterns of the PCB type antenna of FIG. 2 plotted in an H-plane and an E-plane at a 2000 MHz bandwidth; and FIG. 7 is a graph illustrating return loss of the PCB type antenna of FIG. 2.

BEST MODE FOR CARRYING OUT THE INVENTION

Preferred embodiments of the present invention will now be described in detail with reference to the accompanying drawings, in which the same reference numerals are used throughout the different drawings to designate the same or similar components. In the following description, well-known functions and constructions are not described in detail since they would obscure the intention in unnecessary detail.

FIG. 1 is a schematic top view illustrating a wireless communication module incorporating a printed circuit board (PCB) type dual band patch antenna according a preferred embodiment of the invention. Referring to FIG. 1, the wireless communication module 100 includes a wireless communication chip 120 mounted on a PCB substrate 110, a crystal oscillator 130, devices 140, a ground pattern 150 and a radiating patch 160.

The wireless communication chip 120 is adapted to perform wireless transmission and reception by IEEE 802.15.4/4a and can be configured into a single chip or a System on Chip (SoC).

The ground pattern 150 encompasses the wireless communication chip 120 and the crystal oscillator 130 on the same plane with the PCB substrate 110 in an open square shape of 'U' or in other substitutable shapes. The ground pattern 150 is spaced apart from the radiating patch 160 at a predetermined distance.

The radiating patch includes an input arm 190, a main radiator 180 and a slot 170 having 'L' and inverse 'L' shapes combined.

The radiating patch 160, the PCB substrate 110 and the ground pattern 150 constitute the PCB type dual band patch antenna according to the invention.

FIG. 2 is a magnified view illustrating a dual band patch antenna according to a preferred embodiment of the invention. Referring to FIG. 2, the dual band patch antenna includes a feeding part 210, and a radiating patch 160 including an input arm 190 and a main radiator 180 which are divided by a slot 170 with 'L' and inverse 'L' shapes combined.

The feeding part 210 is located in a central portion along a length direction of the PCB board 110 to apply an electrical signal so that the wireless communication chip 120 transmits and receives the electrical signal. Here, the feeding part 210 applies the electrical signal by a coplanar wavelength feeding.

The input arm 190 transfers the electrical signal fed from the feeding part 210 to the main radiator 180 along the slot 170 with 'L' and inverse 'L' shapes combined.

The radiating patch 160 of the dual band patch antenna is connected from the feeding part 20 and includes the slot 170 with 'L' and inverse 'L' shapes combined, which divides the main radiator 180 from the input arm 190. Accordingly, the antenna resonates at both frequency bandwidths.

For example, in case of an antenna for a wireless communication module of IEEE 802.15.4/4a, the antenna resonates at a 900 MHz bandwidth in accordance with a current path defined by the input arm 190, the main radiator 180 and the open terminal 270. Meanwhile, the antenna resonates at a 2400 MHz bandwidth in accordance with a current path formed along the slot 170.

In the antenna structured as above, the input arm 190 of the radiating patch 160 and the open terminal 270 of the main radiator 180 each are spaced apart from the ground pattern 150 at an equal distance, thereby ensuring a symmetrical structure. A smaller distance therebetween increases field intensity. This distance, which is a significant factor for a resonance frequency and radiation efficiency, should be set to an experimentally desirable value.

Also, in the radiating patch 160, the main radiator 180 has the open terminal 270 opposing the input arm 190 with respect to the feeding part 210. This lengthens the antenna to enable resonation at a low frequency and prevents decline in radiation efficiency.

FIG. 3 is an exploded perspective view illustrating a wireless communication module incorporating a PCB type dual band patch antenna according to another embodiment of the invention. A resonance frequency of the antenna is inversely proportional to an electrical length of a radiation surface. Thus in order to lower the resonance frequency, a lower pattern 340 is formed underneath the substrate 110 to connect to the radiating patch 160 having the slot with 'L' and inverse 'L' shapes combined through a via hole 330, thereby extending the electrical length of the antenna.

In this fashion, the lower pattern 340 formed underneath the substrate 110 increases the electrical length of the antenna, thereby downsizing the antenna.

The lower pattern 340 has a shape selected from a group consisting of 'L', inverse 'L', and straight line. Here, the lower pattern 340 is not entirely superimposed with the radiating patch 160 disposed on the PCB substrate. This prevents decrease in radiation amount and bandwidth. The adverse effect from the superimposition is readily apparent to those skilled in the art and thus will be explained in no more detail.

FIG. 4 is a graph illustrating return loss of the feeding part of the PCB type antenna shown in FIG. 2 according to further another preferred embodiment of the invention. The antenna has a dual resonance bandwidth of 850 MHz to 1000 MHz and 2000 MHz at a voltage standing wave ratio (VSWR) of 2:1. This result is obtained when the communication module has a ground pattern with a length of 80 mm.

FIG. 5 illustrates radiation patterns of the PCB type antenna plotted in an H-plane and an E-plane at a 900 MHz bandwidth according to further another preferred embodiment. FIG. 5(*a*) exhibits a non-directional H-plane at a 900 MHz bandwidth and FIG. 5(*b*) shows an E-plane with the shape of the Arabic number '8'. Here, the maximum gain is 1.5 dBi.

FIG. 6 illustrates radiation patterns of the PCB type antenna plotted in an H-plane and an E-Plane at a 2000 MHz bandwidth according to further another embodiment of the invention. FIG. 6(*a*) demonstrates an H-plane having directivity toward the input arm at a 2000 MHz bandwidth. FIG.

6(*b*) shows an E-plane plotted with the maximum gain of 2.1 dBi. This result is obtained when the communication module has a ground pattern with a length of 40 mm.

FIG. 7 is a graph illustrating return loss of the PCB type antenna of FIG. 2 according to further another embodiment of the invention. Referring to FIG. 7, mark 1 is plotted with (−)10.325 dB at 854.2 MHz, mark 2 is plotted with (−)9.5818 dB at 1007.19 MHz, mark 3 is plotted with (−)10.081 dB at 1997.19 MHz and mark 4 is plotted with (−)9.8081 dB at 2539.59 MHz. That is, the dual band antenna of the invention performs wide-band resonance at a low bandwidth of 854 MHz to 1008 MHz and at a high bandwidth of 1990 MHz to 2530 MHz when return loss is −10 dB (VSWR 2:1).

As set forth above, according to preferred embodiments of the invention, a wide-band high-efficiency PCB dual band patch antenna is improved from conventional external and internal ceramic antennas and incorporated in a wireless communication module, accordingly leading to low cost. That is, the PCB type antenna of the invention is internally configured in the wireless communication system as a high-efficiency wide-bandwidth dual band antenna, which includes but not limited to a dual band of 900/2400 MHz when employed in the IEEE 802.15.4/4a wireless communication system.

While the present invention has been shown and described in connection with the preferred embodiments, it will be apparent to those skilled in the art that modifications and variations can be made without departing from the spirit and scope of the invention as defined by the appended claims.

The invention claimed is:

1. A printed circuit board type dual band patch antenna comprising:

a substrate;

a ground pattern formed on the substrate;

a radiating patch formed on the substrate to be spaced apart from the ground pattern at a predetermined distance, the radiating patch including an input arm and a main radiator which are divided by a slot with 'L' and inverse 'L' shapes combined, the main radiator having an open terminal opposing the input arm across the slot; and a feeding part connected to the input arm of the radiating patch to apply an electrical signal to the radiating patch.

2. The printed circuit board type dual band patch antenna according to claim 1, further comprising a lower pattern formed underneath the substrate not to be superimposed with the main radiator, the lower pattern connected to the open terminal of the main radiator through a via hole formed in the substrate.

3. The PCB printed type dual band patch antenna according to claim 2, wherein the lower pattern has a shape selected from a group consisting of 'L', inverse 'L' and straight line.

4. The printed circuit board type dual band patch antenna according to claim 1, wherein the input arm of the radiating patch and the open terminal of the main radiator each are spaced apart from the ground pattern at an equal distance.

5. The printed circuit board type dual band patch antenna according to claim 1, wherein the feeding part applies the electrical signal by a coplanar waveguide feeding.

6. A wireless communication module comprising:

a substrate;

a ground pattern formed on the substrate;

a printed circuit board type dual band patch formed on the substrate to be spaced apart from the ground pattern at a predetermined distance; and a wireless communication device formed on the substrate to be encompassed by the ground pattern.

7. The wireless communication module according to claim 6, wherein the printed circuit board type dual band patch antenna comprises:

a radiating patch formed on the substrate to be spaced apart from the ground pattern at a predetermined distance, the radiating patch including an input arm and a main radiator which are divided by a slot with 'L' and inverse 'L' shapes combined, the main radiator having an open terminal opposing the input arm across the slot; and a feeding part connected to the input arm of the radiating patch to apply an electrical signal to the radiating patch.

8. The wireless communication module according to claim 7, wherein the printed circuit board type dual band patch antenna further comprises a lower pattern formed underneath the substrate not to be superimposed with the main radiator, the lower pattern connected to the open terminal of the main radiator through a via hole formed in the substrate.

9. The wireless communication module according to claim 8, wherein the lower pattern has a shape selected from a group consisting of 'L', inverse 'L', and straight line.

10. The wireless communication module according to claim 7, wherein the printed circuit board type dual band patch antenna is structured such that the input arm of the radiating patch and the open terminal of the main radiator each are spaced apart from the ground pattern at an equal distance.

11. The wireless communication module according to claim 7, wherein the feeding part applies the electrical signal by a coplanar waveguide feeding.

* * * * *